US009947286B2

(12) United States Patent
Lin

(10) Patent No.: US 9,947,286 B2
(45) Date of Patent: Apr. 17, 2018

(54) DISPLAY DRIVING APPARATUS AND METHOD FOR DRIVING DISPLAY APPARATUS

(71) Applicant: Au Optronics Corporation, Hsinchu (TW)

(72) Inventor: Min-Pao Lin, Hsinchu County (TW)

(73) Assignee: Au Optronics Corporation, Hsinchu (TW)

( * ) Notice: Subject to any disclaimer, the term of this patent is extended or adjusted under 35 U.S.C. 154(b) by 236 days.

(21) Appl. No.: 14/617,954

(22) Filed: Feb. 10, 2015

(65) Prior Publication Data

US 2016/0118013 A1 Apr. 28, 2016

(30) Foreign Application Priority Data

Oct. 24, 2014 (TW) ..... 103136813 A

(51) Int. Cl.
*G09G 3/36* (2006.01)
*G09G 3/00* (2006.01)

(52) U.S. Cl.
CPC ..... *G09G 3/3696* (2013.01); *G09G 3/006* (2013.01); *G09G 3/3685* (2013.01); *G09G 2320/0693* (2013.01); *G09G 2330/12* (2013.01)

(58) Field of Classification Search
CPC ..... G09G 3/3639; G09G 3/006
USPC ..... 315/291; 345/212, 174, 204, 214; 361/56, 91.1
See application file for complete search history.

(56) References Cited

U.S. PATENT DOCUMENTS 9,099,029 B2 8/2015 Wu et al.
2008/0259061 A1* 10/2008 Lin ..... G09G 3/3688 345/204
2010/0085368 A1* 4/2010 Shin ..... G09G 5/006 345/534
2011/0234574 A1* 9/2011 Tanaka ..... G09G 3/2096 345/211
2012/0146980 A1* 6/2012 Lee ..... G09G 3/2096 345/211
2012/0169708 A1 7/2012 Wu et al.
2012/0170601 A1* 7/2012 Li ..... B23K 26/0622 372/21
2013/0021306 A1* 1/2013 Kuo ..... G09G 3/20 345/204
2014/0078133 A1 3/2014 Lee et al.
2015/0248856 A1* 9/2015 Kishi ..... G09G 3/3291 345/212

FOREIGN PATENT DOCUMENTS

| | | |
|---|---|---|
| CN | 102184701 | 9/2011 |
| TW | 201032204 | 9/2010 |
| TW | 201248603 | 12/2012 |
| TW | 201409438 | 3/2014 |
| TW | 201413677 | 4/2014 |

* cited by examiner

*Primary Examiner* — Alexander Eisen
*Assistant Examiner* — Mansour M Said
(74) *Attorney, Agent, or Firm* — JCIPRNET

(57) ABSTRACT

A display driving apparatus and a method for driving display apparatus are provided. Source drivers generate abnormality-notify signals according to driving signals. A timing controller determines the source drivers received abnormal driving signals according to the abnormality-notify signals and a horizontal synchronizing signal and adjusts the driving signals corresponding to the source drivers received the abnormal driving signals.

10 Claims, 4 Drawing Sheets

DISPLAY DRIVING APPARATUS AND METHOD FOR DRIVING DISPLAY APPARATUS

CROSS-REFERENCE TO RELATED APPLICATION

This application claims the priority benefit of Taiwan application serial no. 103136813, filed on Oct. 24, 2014. The entirety of the above-mentioned patent application is hereby incorporated by reference herein and made a part of this specification.

BACKGROUND OF THE DISCLOSURE

Field of the Disclosure

The disclosure relates to a display apparatus, and more particularly, relates to a LCD display apparatus.

Description of Related Art

In the conventional technology, a method of applying a drive IC in a liquid crystal display (LCD) may include, for example, connecting a printed circuit board (PCB) having a timing controller to a LCD panel. Therein, the drive IC (e.g., gate drivers and source drivers) manufactured by using a chip on glass (COG) technology is included on the LCD panel. Accordingly, by installing a driving circuit on the LCD panel, and followed by connecting the LCD panel to the timing controller by using the PCB, advantages such as compactness and low costs may then be achieved.

Therein, a resistance of the PCB, an internal resistance of the source drivers and a driving current of the source drivers may all be the reasons why signals received by the source drivers from the timing controller are unstable to cause an abnormal display on the LCD. When the abnormal display occurs on the LCD, the conventional LCD technology is incapable of automatically detecting which one of the source drivers is causing the abnormal display. Instead, each of the source drivers must be inspected one by one in order to eliminate the abnormal display, and resulting in a great waste of labor and time costs.

SUMMARY OF THE DISCLOSURE

The disclosure is directed to a display driving apparatus and a method for driving a display apparatus, which are capable of automatically detecting the source driver where abnormality occurs, and adjusting a driving signal outputted to the source driver.

In a method for driving a display apparatus of the disclosure, the display apparatus includes a plurality of source drivers, and the method includes the following steps. An amplitude of a driving signal for driving each of the source drivers is detected. Whether a voltage of the driving signal is less than a preset voltage value is determined. When the voltage of the driving signal is less than the preset voltage value, an abnormality-notify signal having a first logic level is generated. Therein, the abnormality-notify signal indicates that the driving signal is abnormal. Whether the abnormality-notify signal is transformed from a second logic level to the first logic level is determined. It is determined that the driving signal of one of the source drivers is abnormal according to a horizontal synchronizing signal and a transition time of the abnormality-notify signal when the abnormality-notify signal is transformed from the second logic level to the first logic level. The driving signal of the one of the source drivers is adjusted.

In an embodiment of the disclosure, the step of adjusting the driving signal of the one of the source drivers includes: adjusting at least one of an internal resistance of the source drivers, an internal resistance of a timing controller, a driving current of the source drivers, and a driving current of the timing controller, and outputting a calibrated driving signal to the one of the source drivers.

In an embodiment of the disclosure, the method further includes: storing the calibrated driving signal, the internal resistance of the source drivers, the internal resistance of the timing controller, the driving current of the source drivers, and the driving current of the timing controller in order to obtain a plurality of calibration values.

In an embodiment of the disclosure, the method further includes: driving the source driver according to the calibration value and the calibrated driving signal.

In an embodiment of the disclosure, the step of determining whether the voltage of the driving signal is less than the preset voltage value includes: determining whether the voltage of the driving signal increases to the preset voltage value within a preset time, wherein when the voltage of the driving signal does not increase to the preset voltage value within the preset time, the abnormality-notify signal is set to be the first logic level.

A display driving apparatus of the disclosure includes a plurality of source drivers and a timing controller. The source drivers are configured to detect an amplitude of a corresponding driving signal, and generate an abnormality-notify signal having a first logic level when a voltage of the driving signal is less than a preset voltage value. The timing controller is coupled to the source drivers, and the timing controller outputs the driving signal to the source drivers, receives the abnormality-notify signal, and determines a logic level of the abnormality-notify signal. It is determined that the driving signal of one of the source drivers is abnormal according to a horizontal synchronizing signal and a transition time of the abnormality-notify signal when the abnormality-notify signal is transformed from a second logic level to the first logic level. Then, the driving signal of the one of the source drivers is adjusted.

In an embodiment of the disclosure, the timing controller is configured to adjust at least one of an internal resistance of the source drivers, an internal resistance of the timing controller, a driving current of the source drivers, and a driving current of the timing controller, so as to adjust the amplitude of the driving signal.

In an embodiment of the disclosure, the timing controller further includes a memory, which is configured to store the calibrated driving signal, the internal resistance of the source drivers, the internal resistance of the timing controller, the driving current of the source drivers, and the driving current of the timing controller in order to obtain a plurality of calibration values.

In an embodiment of the disclosure, the timing controller drives the source drivers according to the calibration value and the calibrated driving signal.

In an embodiment of the disclosure, each of the source drivers determines whether the voltage of the driving signal increases to the preset voltage value within a preset time, and sets the abnormality-notify signal to be the first logic level when the voltage of the driving signal does not increase to the preset voltage value within the preset time.

To make the above features and advantages of the disclosure more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
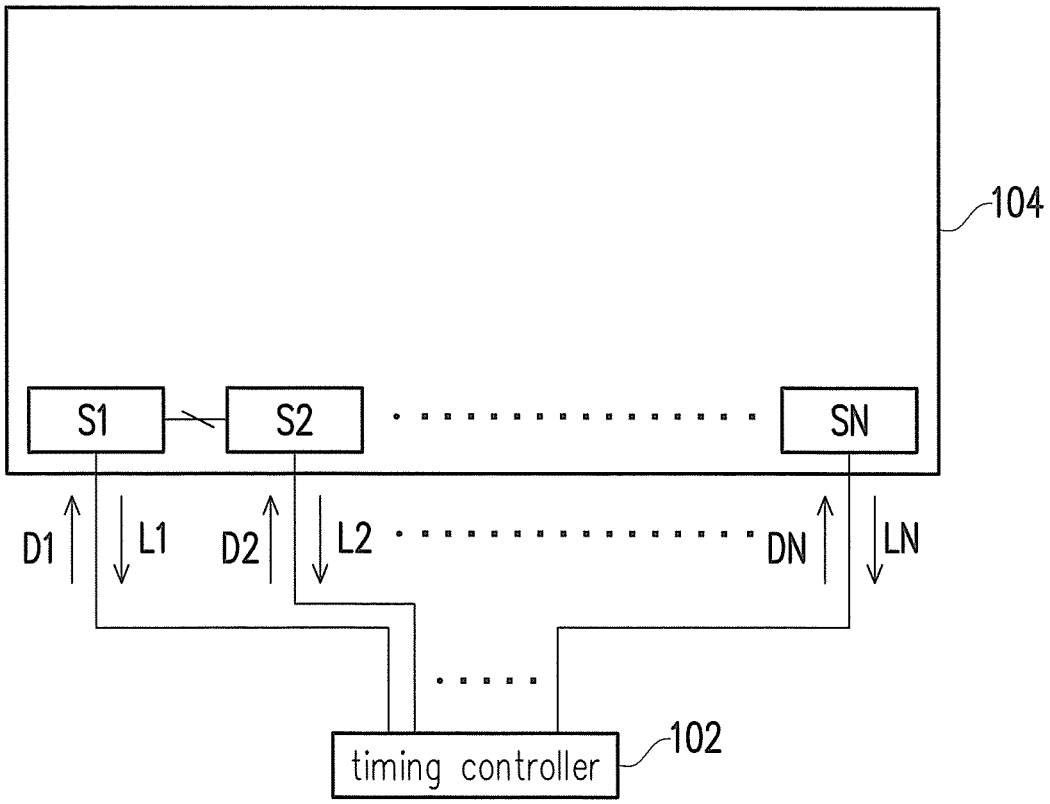
FIG. 1 is a schematic diagram illustrating a display driving apparatus according to an embodiment of the disclosure.

Reference will now be made in detail to the present preferred embodiments of the disclosure, examples of which are illustrated in the accompanying drawings. Wherever possible, the same reference numbers are used in the drawings and the description to refer to the same or like parts.

FIG. 1 is a schematic diagram illustrating a display driving apparatus according to an embodiment of the disclosure. Referring to FIG. 1, the display driving apparatus in a display apparatus includes a timing controller 102, a plurality of source drivers S1 to SN and a display panel 104, in which N is a positive integer. The timing controller 102 is coupled to the source drivers S1 to SN, and a coupling method thereof includes, for example, connecting by using a flexible print circuit board. The timing controller 102 may be, for example, disposed on a printed circuit board. The source drivers S1 to SN may be manufactured on the display panel 104 by using a chip on glass (COG) technology. The source drivers S1 to SN are capable of outputting data signals to the display panel 104 according to driving signals D1 to DN from the timing controller 102, so as to drive the display panel 104 to display corresponding image frames. An amplitude of each of the driving signals D1 to DN is detected in order to generate abnormality-notify signals L1 to LN respectively for the timing controller 102. If the source driver detects that a voltage of the driving signal is less than a preset voltage value, the source driver can output an abnormality-notify signal having a first logic level (e.g., a low voltage logic levels) to the timing controller 102. Otherwise, if the source driver detects that the voltage of the driving signal is not less than the preset voltage value, the source driver can output the abnormality-notify signal having a second logic level (e.g., a low voltage logic levels) to the timing controller 102.

For example, a method for the source drivers S1 to SN to determine whether the voltage of the driving signal is less than the preset voltage value may include the followings. First, whether the voltage of the driving signal increases to the preset voltage value within a preset time is determined. If the voltage of the driving signal does not increase to the preset voltage value within the preset time, it indicates that the strength of the driving signal is insufficient. In this case, the source driver sets the abnormality-notify signal outputted to the timing controller 102 to be the first logic level. Otherwise, if the voltage of the driving signal increases to the preset voltage value within the preset time, it indicates that the strength of the driving signal has no problem. In this case, the source driver sets the abnormality-notify signal outputted to the timing controller 102 to be the second logic level. Aforesaid signal amplitude represents strength of the signal, and the strength may also be a voltage difference, a current magnitude and so on. In the embodiments of the disclosure, whether the voltage reaches a specific level serves to represent the signal strength, but the disclosure is not limited thereto.

On the other hand, after the abnormality-notify signals L1 to LN outputted by the source drivers S1 to SN are received, the timing controller 102 determines a logic level of the abnormality-notify signals L1 to LN. When one specific abnormality-notify signal is transformed from the second logic level to the first logic level, it indicates that a situation has occurred in which the driving signal received by the corresponding source driver is abnormal (e.g., the strength of the driving signal is insufficient). In this case, the timing controller 102 can determine the source driver having the abnormal driving signal according to a horizontal synchronizing signal and a transition time of the abnormality-notify signal. The transition time of the signal may be a time required for the signal to transform from the first logic level to the second logic level.

Figure 2:
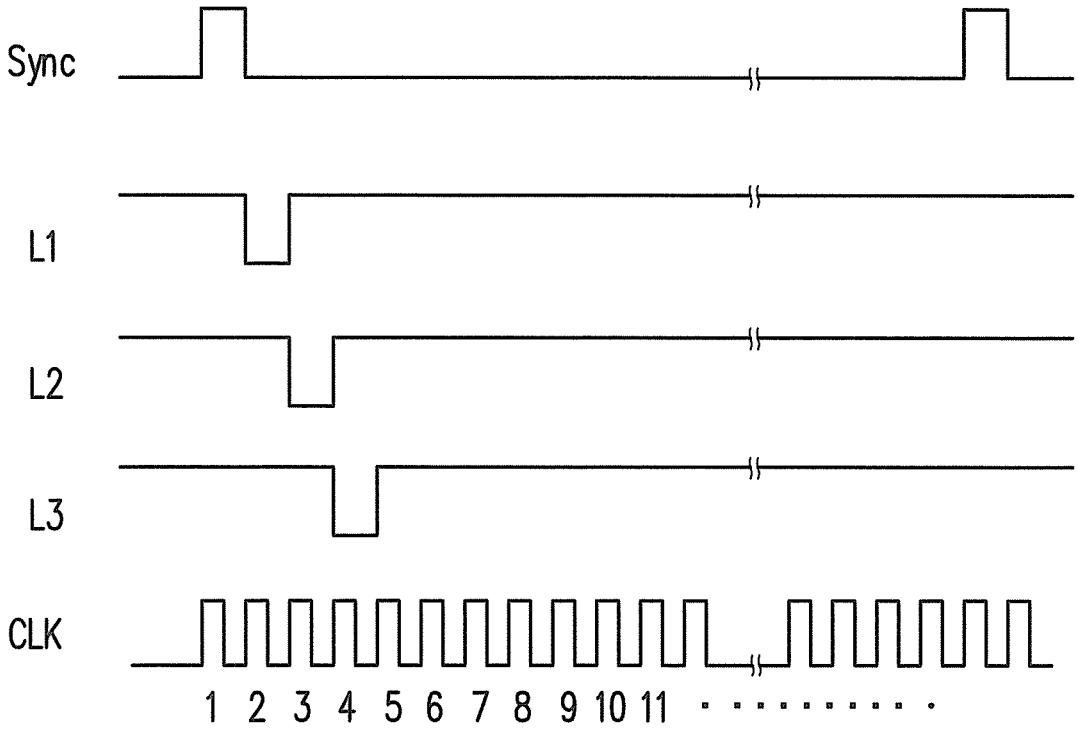
FIG. 2 is a schematic diagram illustrating waveforms of a horizontal synchronizing signal, an abnormality-notify signal and a timing signal according to an embodiment of the disclosure.

For instance, FIG. 2 is a schematic diagram illustrating waveforms of a horizontal synchronizing signal, an abnormality-notify signal and a timing signal according to an embodiment of the disclosure. Referring to FIG. 2, a horizontal synchronizing signal Sync is configured to instruct a time to start driving the source drivers S1 to SN for providing the data signals to the display panel 104. After the horizontal synchronizing signal Sync is transformed to a high voltage logic level, the timing controller 102 can start counting a clock signal CLK, and the source drivers S1 to SN can sequentially output the abnormality-notify signals L1 to LN to the timing controller 102 according to a result of determining the driving signals D1 to DN based on the detection. The timing controller 102 can determine the source driver received the abnormal driving signal according to a time when the abnormality-notify signal having the first logic level (the low logic level as in the embodiment of FIG. 2) is received. For example, in the embodiment of FIG. 2, when a counted value of the clock signal CLK is at 2, 3 and 4, the timing controller 102 receives the abnormality-notify signals L1, L2 and L3 which are transformed from the high logic level to the low logic level, and this indicates that each of the source drivers S1, S2 and S3 receives the abnormal driving signal.

After the source drivers corresponding to the abnormal signals are determined by the timing controller 102, the timing controller 102 can then perform an adjustment on the strength of the driving signal for the source drivers having the abnormal driving signal, so as to ensure that each of the source drivers can be successfully driven by the timing controller 102 such that the display panel 104 can display the frames normally. For instance, the timing controller 102 can adjust at least one of an internal resistance of the source drivers having the abnormal driving signal, an internal resistance of the timing controller 102, a driving current of the source drivers and a driving current of the timing controller. Accordingly, the amplitude of the driving signal with insufficient driving signal strength may be enhanced, so that a calibrated driving signal can be outputted to one of the source drivers (e.g., the source driver having the insufficient driving signal strength).

In addition, in some embodiments, the timing controller 102 can also store the calibrated driving signal, the internal resistance of the source drivers S1 to SN, the internal resistance of the timing controller 102, the driving current of the source drivers S1 to SN and the driving current of the timing controller 102 in a memory in order to obtain a plurality of calibration values. In another embodiment, the memory may also be disposed in the timing controller 102. However, the disclosure is not limited thereto, and the memory may also be a non-volatile memory. Thereafter, the timing controller 102 can drive the source drivers S1 to SN according to the calibration values (i.e., an optimized strength of the driving signal) to ensure that the source drivers S1 to SN can all be successfully driven by the timing controller 102, so that the display panel 104 can display the frames normally.

Figure 3:
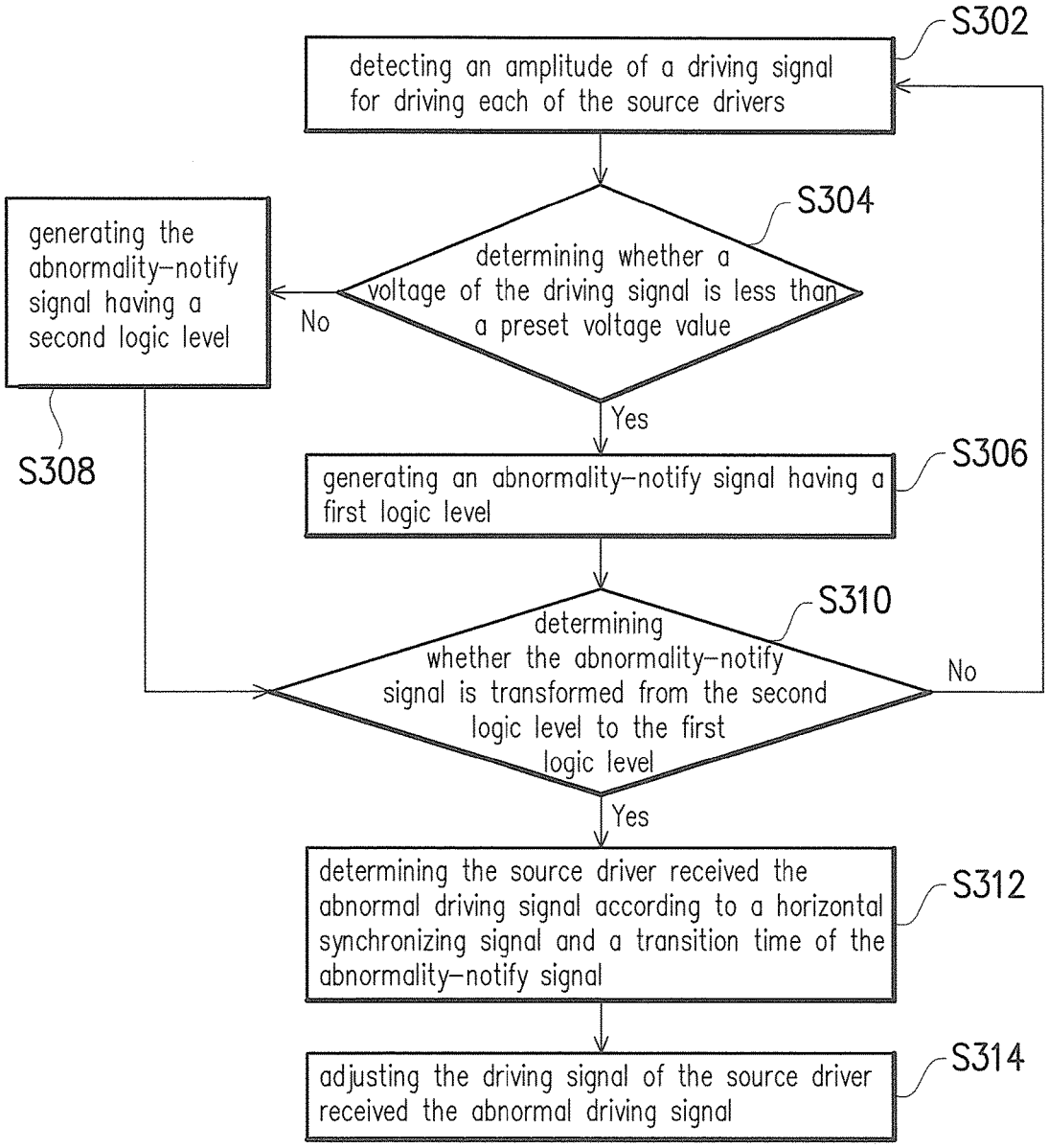
FIG. 3 is a flowchart illustrating a method for driving a display apparatus according to an embodiment of the disclosure.

FIG. 3 is a flowchart illustrating a method for driving a display apparatus according to an embodiment of the disclosure. Referring to FIG. 3. In view of the foregoing embodiments, a method for driving the display apparatus may include the following steps. First of all, an amplitude of a driving signal for driving each of the source drivers is detected (step S302). Subsequently, whether a voltage of the driving signal is less than a preset voltage value is determined (step S304) For example, whether the voltage of the driving signal increases to the preset voltage value within a preset time can be determined. If the voltage of the driving signal does not increase to the preset voltage value within the preset time, it indicates that the strength of the driving signal is insufficient. When the voltage of the driving signal is less than the preset voltage value, an abnormality-notify signal having a first logic level is generated (step S306). Therein, the abnormality-notify signal indicates that the driving signal is abnormal. Otherwise, if the voltage of the driving signal is not less than the preset voltage value, the abnormality-notify signal having a second logic level is generated (step S308). After the abnormality-notify signal is generated according to a result of determining whether the voltage of the driving signal is less than the preset voltage value, proceeding to step S310 in which whether the abnormality-notify signal is transformed from the second logic level to the first logic level is determined. When the abnormality-notify signal is transformed from the second logic level to the first logic level, the source drivers received the abnormal driving signal is determined according to a horizontal synchronizing signal and a transition time of the abnormality-notify signal (step S312). Thereafter, the driving signal of the source driver received the abnormal driving signal is adjusted (step S314).

Figure 4:
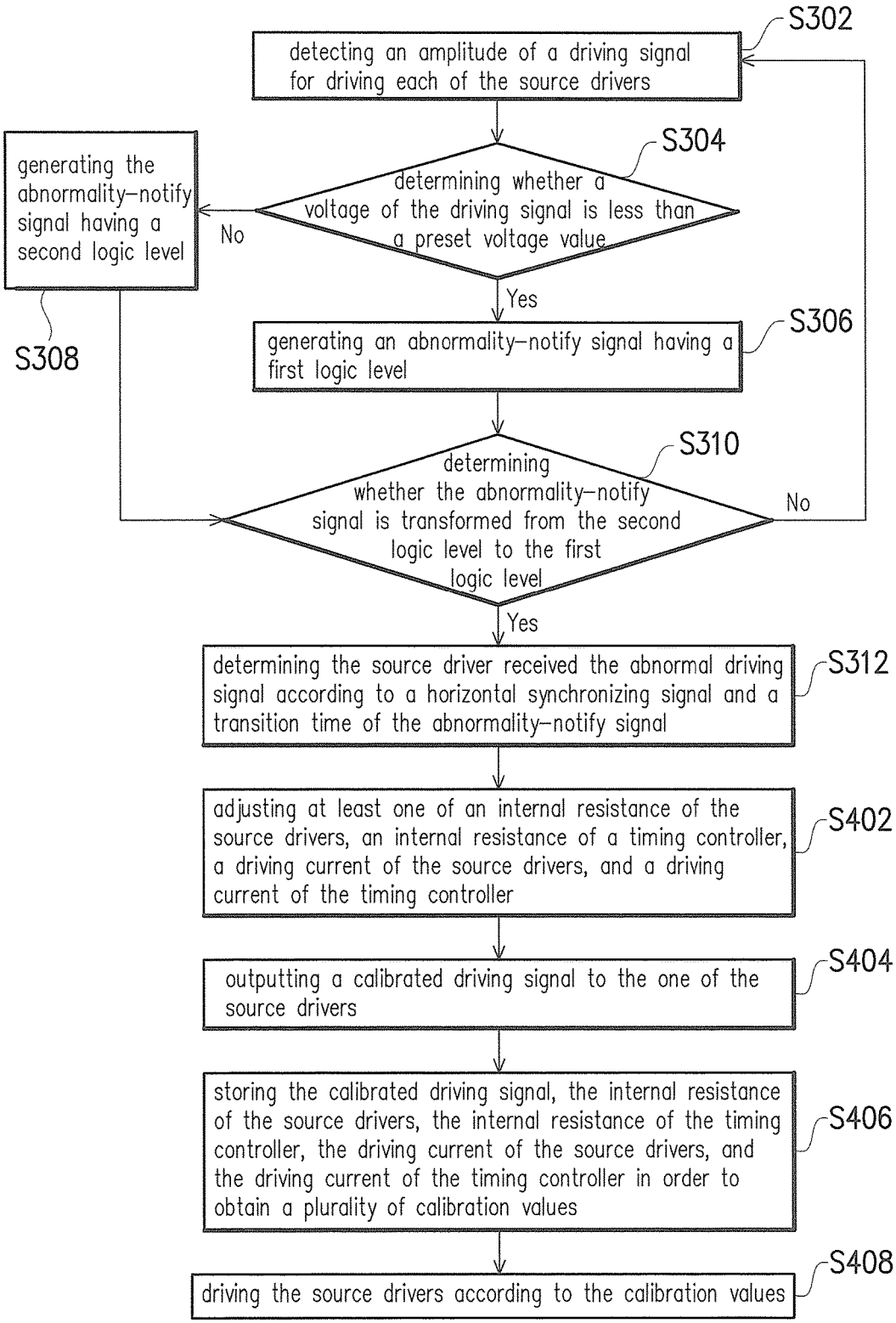
FIG. 4 is a flowchart illustrating a method for driving a display apparatus according to another embodiment of the disclosure.

FIG. 4 is a flowchart illustrating a method for driving a display apparatus according to another embodiment of the disclosure. Referring to FIG. 4. A difference between the present embodiment and the embodiment of FIG. 3 is that, after step S312, at least one of an internal resistance of the source drivers, an internal resistance of a timing controller, a driving current of the source drivers, and a driving current of the timing controller is adjusted (step S402), and then a calibrated driving signal is outputted to the one of the source drivers (step S404). In addition, after step S404, the calibrated driving signal, the internal resistance of the source drivers, the internal resistance of the timing controller, the driving current of the source drivers, and the driving current of the timing controller are stored in order to obtain a plurality of calibration values (step S406). Thereafter, the source drivers are driven according to the calibration values (step S408) to ensure that the source drivers can be successfully driven, so that the display panel can display the frames normally.

In summary, according to the embodiments of the disclosure, the source drivers are capable of generating the abnormality-notify signals according to the strength of the driving signal, and the timing controller is capable of determining the source driver received the abnormal driving signal according to the abnormality-notify signal and a horizontal synchronizing signal generated by the source driver and adjusting the strength of the driving signal thereof. Accordingly, the source drivers having the abnormality can be quickly determined and the problem of the abnormal display can be solved to substantially reduce manufacturing costs of the display apparatus. In some embodiments, the calibration values are also be stored, and the source drivers are driven according to the calibration values to ensure that the source drivers can be successfully driven, so that the display panel can display the frames normally.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A method for driving a display apparatus, the display apparatus comprising a plurality of source drivers, and the method comprising:

detecting an amplitude of a driving signal for driving each of the source drivers;

determining whether an amplitude of the driving signal is less than a preset value;

generating an abnormality-notify signal having a first logic level when the amplitude of the driving signal is less than the preset value, wherein the abnormality-notify signal indicates that the driving signal is abnormal;

determining whether the abnormality-notify signal is transformed from a second logic level to the first logic level;

determining which source driver among the source drivers has an abnormal driving signal according to a horizontal synchronizing signal and a transition time of the abnormality-notify signal when the abnormality-notify signal is transformed from the second logic level to the first logic level; and adjusting the abnormal driving signal of the source driver having the abnormal driving signal to enhance the driving signal with insufficient driving signal strength.

2. The method of claim 1, wherein the step of adjusting the abnormal driving signal of the source driver having the abnormal driving signal comprises:

adjusting at least one of an internal resistance of the source drivers, an internal resistance of a timing controller, a driving current of the source drivers, and a driving current of the timing controller, and outputting a calibrated driving signal to the one of the source drivers.

3. The method of claim 2, further comprising storing the calibrated driving signal, the internal resistance of the source drivers, the internal resistance of the timing controller, the driving current of the source drivers, and the driving current of the timing controller in order to obtain a plurality of calibration values.

4. The method of claim 3, further comprising driving the source drivers according to the calibration values.

5. The method of claim 1, wherein the step of determining whether the amplitude of the driving signal is less than the preset value comprises:

determining whether the amplitude of the driving signal increases to the preset value within a preset time, wherein when the amplitude of the driving signal does not increase to the preset value within the preset time, the abnonnality-notify signal is set to be the first logic level.

6. A display driving apparatus, comprising:

a plurality of source drivers, configured to detect a amplitude of a corresponding driving signal, and generate an abnormality-notify signal having a first logic level when an amplitude of the driving signal is less than a preset value; and a timing controller, coupled to the source drivers, and configured to output the driving signal to the source drivers and receive the abnormality-notify signal, determine a logic level of the abnormality-notify signal, determine which source driver among the source drivers has an abnormal driving signal according to a horizontal synchronizing signal and a transition time of the abnormality-notify signal when the abnormality-notify signal is transformed from a second logic level to the first logic level, and adjust the abnormal driving signal of the source driver having the abnormal driving signal to enhance the driving signal with insufficient driving signal strength.

7. The display driving apparatus of claim 6, wherein the timing controller is configured to adjust at least one of an internal resistance of the source drivers, an internal resistance of the timing controller, a driving current of the source drivers, and a driving current of the timing controller, and output a calibrated driving signal to the one of the source drivers.

8. The display driving apparatus of claim 7, further comprising: a memory, configured to store the calibrated driving signal, the internal resistance of the source drivers, the internal resistance of the timing controller, the driving current of the source drivers, and the driving current of the timing controller in order to obtain a plurality of calibration values.

9. The display driving apparatus of claim 8, wherein the timing controller drives the source drivers according to the calibration values.

10. The display driving apparatus of claim 6, wherein each of the source drivers determines whether the amplitude of the driving signal increases to the preset value within a preset time, and sets the abnormality-notify signal to be the first logic level when the amplitude of the driving signal does not increase to the preset value within the preset time.

* * * * *